US009688443B2

(12) United States Patent
Hanten

(10) Patent No.: US 9,688,443 B2
(45) Date of Patent: Jun. 27, 2017

(54) PACKAGING COMBINATION

(71) Applicant: Poly-clip System GmbH & Co. KG, Hattersheim (DE)

(72) Inventor: Jürgen Hanten, Bad Nauheim (DE)

(73) Assignee: Poly-clip System GmbH & Co. KG, Hattersheim (DE)

( * ) Notice: Subject to any disclaimer, the term of this patent is extended or adjusted under 35 U.S.C. 154(b) by 0 days.

(21) Appl. No.: 13/751,046

(22) Filed: Jan. 25, 2013

(65) Prior Publication Data

US 2013/0213999 A1 Aug. 22, 2013

(30) Foreign Application Priority Data

Jan. 27, 2012 (EP) ..... 12 000 555

(51) Int. Cl.
*B67D 1/00* (2006.01)
*B65D 35/28* (2006.01)
*B65D 75/58* (2006.01)

(52) U.S. Cl.
CPC ..... *B65D 35/28* (2013.01); *B65D 75/5872* (2013.01)

(58) Field of Classification Search
CPC ..... B05C 17/00583; B65D 35/28
(Continued)

(56) References Cited

U.S. PATENT DOCUMENTS 1,965,271 A * 7/1934 Wharton ..... 222/95
2,712,886 A * 7/1955 Young ..... B65D 25/48 222/91

(Continued)

FOREIGN PATENT DOCUMENTS

AT 383329 B 6/1987
DE 3500625 A1 8/1985

(Continued)

OTHER PUBLICATIONS

DE3831225A1—English abstract and machine translation obtained from Espacenet (http://worldwide.espacenet.com) on Jan. 25, 2013, 3 pages.

(Continued)

*Primary Examiner* — Patrick M Buechner
*Assistant Examiner* — Michael J Melaragno
(74) *Attorney, Agent, or Firm* — Fitch, Even, Tabin & Flannery LLP

(57) ABSTRACT

The present invention relates to a packaging combination for accommodating and dispensing a filling material. The packaging combination comprises a tubular casing having a first end, a second end and a central axis extending through first and second ends, wherein the tubular casing is tightly filled with filling material and closed at its first and second end by a closure means. The packaging combination further comprises a dispensing system including a dispensing device having a passageway extending through the dispensing device with an inlet opening at its one end and an outlet opening at its other end and being attached to the first end of the tightly filled tubular casing, the first end of the tubular casing extending inside the passageway. The system further comprises a dispensing cap having an attachment end and a dispensing end reversibly attachable to the outlet opening of the dispensing device, by its attachment end.

13 Claims, 8 Drawing Sheets

(58) Field of Classification Search
USPC ..... 222/83, 88, 91, 80
See application file for complete search history.

(56) References Cited

U.S. PATENT DOCUMENTS

| | | | | | |
|---|---|---|---|---|---|
| 3,182,858 | A * | 5/1965 | Beaudoin | B65D 51/225 | 222/546 |
| 3,339,812 | A * | 9/1967 | Meissner | B65D 51/222 | 220/278 |
| 3,402,855 | A * | 9/1968 | Schroeder | B65D 81/3222 | 220/277 |
| 3,613,955 | A * | 10/1971 | Wetherell, Jr. | B65D 51/20 | 206/222 |
| 4,307,821 | A * | 12/1981 | McIntosh | B65D 41/3442 | 215/256 |
| 4,456,150 | A * | 6/1984 | Yang | 222/83 | |
| 4,884,705 | A * | 12/1989 | Debetencourt | 215/250 | |
| 5,301,839 | A * | 4/1994 | Eierle et al. | 222/95 | |
| 5,443,181 | A * | 8/1995 | Popp et al. | 222/95 | |
| 5,501,368 | A * | 3/1996 | Brandhorst et al. | 222/95 | |
| 5,549,389 | A * | 8/1996 | Takagaki et al. | 383/202 | |
| 5,642,838 | A * | 7/1997 | Stoody | 222/83 | |
| 5,897,028 | A * | 4/1999 | Sauer | 222/82 | |
| 6,223,941 | B1 * | 5/2001 | Nealey | 222/82 | |
| 6,299,022 | B1 * | 10/2001 | Bublewitz et al. | 222/83.5 | |
| 6,564,970 | B1 * | 5/2003 | Walch et al. | 222/82 | |
| 6,644,509 | B1 * | 11/2003 | Bublewitz et al. | 222/88 | |
| 7,194,847 | B2 * | 3/2007 | Summons et al. | 53/433 | |
| 8,172,109 | B2 * | 5/2012 | Cadden | 222/94 | |
| 2002/0020718 | A1 | 2/2002 | Summons et al. | | |
| 2007/0272571 | A1 | 11/2007 | Czopor et al. | | |
| 2007/0278251 | A1 * | 12/2007 | Guerrera et al. | 222/327 | |
| 2008/0245314 | A1 * | 10/2008 | Brodowski | A01N 25/34 | 119/651 |
| 2008/0272182 | A1 | 11/2008 | Hanten | | |
| 2008/0274313 | A1 | 11/2008 | Hanten | | |
| 2009/0179045 | A1 * | 7/2009 | Cadden | 222/94 | |
| 2013/0270293 | A1 * | 10/2013 | Dresser | B65D 5/748 | 222/83 |

FOREIGN PATENT DOCUMENTS

| | | | |
|---|---|---|---|
| DE | 3831225 | A1 | 3/1990 |
| DE | 102008040748 | A1 | 1/2010 |
| EP | 1988032 | A1 | 11/2008 |
| EP | 2157026 | A1 | 2/2010 |
| EP | 2522594 | A1 | 11/2012 |
| EP | 2557055 | A1 | 2/2013 |
| FR | 2741551 | A3 | 5/1997 |
| GB | 2227239 | A | 7/1990 |
| JP | 10101155 | A | 4/1998 |
| JP | 2001260595 | A | 9/2001 |
| JP | 2011-527976 | | 11/2011 |
| WO | 2010-006455 | A1 | 1/2010 |

OTHER PUBLICATIONS

EP1988032A1—English abstract and machine translation obtained from Espacenet (http://worldwide.espacenet.com) on Jan. 25, 2013, 13 pages.

Office Action issued in corresponding Japanese Application No. 2013-012981 dated Nov. 7, 2016 and English translation of same (8 pages).

* cited by examiner

PACKAGING COMBINATION

This application claims priority to, and the benefit of, European Patent Application No. 12 000 555.8-2308 filed Jan. 27, 2012 with the European Patent Office, which is hereby incorporated by reference.

BACKGROUND OF THE INVENTION

The present invention relates to a packaging combination for accommodating and dispensing a viscous or granular filling material according to claim 1. The present invention further relates to dispensing system according to claim 15 for being attached to a tightly filled tubular casing.

In particular, the present invention relates to a packaging combination for accommodating and dispensing a viscous or granular filling material. The packaging combination comprises a tubular casing having a first end, a second end and a central Axis extending through first end second ends, wherein the tubular casing is tightly filled with filling material and closed at its first and second end by a closure means, like a closure clip. The packaging combination comprises a dispensing device having a passageway extending through the dispensing device with an inlet opening at its one end and an outlet opening at its other end for guiding and dispensing the filling material in a dispensing direction, and being attached to the first end of the tightly filled tubular casing. The first end of the tubular casing extends into the passageway of the dispensing device. The dispensing device further comprises a dispensing cap having an attachment end and a dispensing end, which is reversibly attachable to the outlet opening of the dispensing device, by its attachment end.

In practice, packaging combinations are known, which comprise a tubular casing filled with filling material and closed at its ends by closure means, and a dispensing device. The tubular casings of said packaging combinations are filled with various pasty filling materials, e.g. food stuff, like sausage meat, or adhesives, like silicone, etc.

From EP patent application 1 988 032, a tubular or sausage-shaped packaging is known, being filled with sausage meat. The sausage-shaped product is produced by closing a tubular casing at one end, filling the sausage meat into said tubular casing and closing the filled tubular casing at its respective other end. In order to allow an easier opening of the sausage-shaped product, perforation lines including a number of weak locations are provided on the casing, along which the casing may be opened by pulling-off the casing material and dispensing the sausage meat.

In US patent application 2008/0274313, a sausage-shaped product similar to that of EP patent application 1 988 032 is disclosed. In order to allow an easier opening of the casing material, a handle in form of a tear stripe is attached to the casing, in particular between the two overlapping longitudinal edges of the casing material. Two material weakenings are provided at both sides of the tear stripe facilitating the opening of the casing.

Moreover, German laid open document 38 31 225 discloses a device for dispensing the filling material, like an adhesive, stored in a tubular or bag-shaped packaging. The device includes a rigid tube having a dispensing nozzle at its one end. For the use of the filling material, the bag-shaped packaging has to be opened at one end and has then to be positioned in said rigid tube with its opened end facing the dispensing nozzle. A piston matching the inner diameter of the tube is pushed into the tube, thereby squeezing the bag-shaped packaging and dispensing the filling material through the dispensing nozzle.

With this known packaging combination, it is of disadvantage that the rigid tube has outer circumferential dimensions being such that the complete bag-shaped packaging can be accommodated in said rigid tube. If this known packaging combination is provided as a disposable device, this solution is expensive due to the big rigid tube being made from relatively expensive plastics. If this known packaging combination used such that only the bag-shaped packaging is thrown away and the rigid tube is used several times, the bag-shaped packaging must be opened outside the tube so that, when the opened bag-shaped packaging is introduced in the rigid tube, filling material can accidently discharged and can pollute the environment.

Thus, it is an object of the present invention to provide a packaging combination, with which the above mentioned drawbacks have been overcome, and, in particular, which allows an easy and save opening of the tubular casing as well as an easy and save dispensing of the filling material.

SUMMARY OF THE INVENTION

According to the present invention, there is provided a packaging combination for accommodating and dispensing a viscous or granular filling material. The packaging combination comprises a tubular casing having a first end, a second end and a central Axis extending through first end second ends, wherein the tubular casing is tightly filled with filling material and closed at its first and second end by a closure means, like a closure clip. The packaging combination further comprises a dispensing system which includes a dispensing device having a passageway extending through the dispensing device with an inlet opening at its one end and an outlet opening at its other end for guiding and dispensing the filling material in a dispensing direction, and being attached to the first end of the tightly filled tubular casing. The first end of the tubular casing extends into the passageway of the dispensing device. The dispensing system further comprises a dispensing cap having an attachment end and a dispensing end, which is reversibly attachable to the outlet opening of the dispensing device, by its attachment end.

A packaging combination of this configuration already includes all necessary parts for easy and safe dispensing the filling material contained in the tubular casing just by squeezing the filled tubular casing portion. Moreover, since the dispensing system is already attached to the filled tubular casing, an accidental discharge of filling material after opening the tubular casing and before inserting the opened casing into a dispensing tube is avoided.

In order to allow an easy opening of the tightly filled tubular casing, the dispensing cap comprises at least one cutting element for opening the tubular casing at its first end.

In an advantageous configuration, the at least one cutting element extends from the attachment end of the dispensing cap in a direction opposite to the dispensing direction. Thereby, the tightly filled tubular casing may be opened just by firmly attaching the dispensing cap to the second portion of the dispensing device.

In a further advantageous embodiment of the inventive packaging combination, the dispensing cap further comprises a cap member having a central axis, an opened end and a closed end, arranged at the attachment end of the dispensing cap and coaxially aligned to central axis, with its opened end directed towards the tubular casing.

In this configuration, the cap member is positioned above the closure clip closing the first end of the tubular casing, for accommodating the plait-like portion together with said closure clip, when the tubular casing has been opened by the cutting element. The cap member prevents the plait-like portion together with said closure clip from blocking the dispensing end of the dispensing cap.

For positioning said cap member above the first end of the tubular casing, the cap member is advantageously arranged inside the dispensing cap, in closed vicinity to its attachment end. Moreover, for fixing the cap member, and for allowing the filling material passing the cap member, at least one bar is provided, by means of which the cap member is attached to the dispensing cap. Between cap member and the inner surface of the dispensing cap, thereby, an at least approximately circular or partially circular slot is formed for allowing the filling material passing the cap member. Naturally, more than one bar may be provided for attaching the cap member to the dispensing cap. Accordingly more than one partially circular slot is formed.

In case that the dispensing cap comprises said cap member, the at least one cutting element may be arranged in the region of the opened end of the cap member. The opened end of the cap member terminates in an annular or circular ring shaped surface, which is arranged in a plane parallel to the attachment end of the dispensing cap. Further advantageously, the opened end of the cap member and the attachment end of the dispensing cap lying in a common plane extending at least approximately rectangular to the central axis of the tubular casing.

To guarantee that a packaging combination is originally closed, an indicating unit for indicating the originality of the closure is provided at the dispensing system.

Further advantageously, in the originally closed condition of the packaging combination, the indicating unit is adapted to fix the dispensing cap in a predefined position relative to the dispensing device. Thereby, the tubular casing is not unintentionally damaged by the cutting element extending from the attachment end of the dispensing cap.

In an advantageous embodiment of the packaging combination according to the present invention, the dispensing device includes at least a first portion and a second portion, wherein the first portion extends from the inlet opening of the passageway in the dispensing direction and the second portion extends from the outlet opening opposite to the dispensing direction, and wherein the inner circumferential dimensions of the first portion corresponds at least approximately to the outer circumferential dimensions of the tubular casing.

That means, the cross-section of the first portion of the dispensing device corresponds to the cross-section of the tubular casing, i.e. both, the first portion and the tubular casing, are of a circular cross-section, whereby the outer diameter of the tubular casing corresponds to the inner diameter of the first portion of the dispensing device. This allows a form-fit attachment of the dispensing system, and in particular of the dispensing device, to the tightly filled tubular casing. The term "circumferential dimension" has not only to be understood as the sole circumference, but also as a dimension characterizing a cross-section, like the length or width of a rectangle, a side length of a triangle or a diameter of a circle. Naturally, the first portion of the dispensing device and the tubular casing may be of any other suitable form, i.e. of a rectangular or triangular shape, the remarkable point is that their cross-sections or circumferential dimensions correspond to each other.

In a further advantageous configuration, a circumferential flange extends at the inner surface of the dispensing device in a region between the first portion and the second portion. Said circumferential flange provides a stop or abutment for restricting the insertion depth of the first end of the tubular casing into the first portion of the dispensing device. Moreover, said flange or the circumferential edge between the flange and the second portion of the dispensing device provide a place for position an adhesive, like a hot-melt adhesive or the like, in order to fix the dispensing device on the tubular casing for avoiding the dispensing device from dropping off from the tubular casing.

According to a preferred constitution of the inventive packaging combination, an internal screw thread is provided at the outlet opening of the dispensing device, and a corresponding external screw thread is provided at the attachment end of the dispensing cap for being attached to the outlet opening of the dispensing device. By means of said screw thread combination, the dispensing cap may securely be attached to the dispensing device. Alternative attachment means may be used to attach the dispensing cap to the dispensing device, like a bayonet connector including pins extending from the dispensing cap and corresponding slots in the second portion of the dispensing device, for accommodating said pins.

In an advantageous embodiment of the inventive packaging combination, the dispensing cap comprises a protrusion extending at its outside in the region of the end of the external screw tread directed towards the dispensing opening, for restricting its screw-in depth. Additionally, said protrusion may also assist securing the dispensing cap when firmly attached to the second portion of the dispensing device, by a frictional force between said protrusion and the outer edge of the outlet opening of the second portion of the dispensing device.

In a preferred embodiment, the indicating unit is a tear-off strip provided between the outlet opening of the dispensing device and the protrusion extending from the dispensing cap. Said tear-off strip may be removed by hand without the need of without any additional tool. The indicating unit, and in particular, the tear-off strip, when positioned between the outlet opening of the dispensing device and the protrusion extending from the dispensing cap, prevents the dispensing cap from being firmly attached to the dispensing device. Thus, the first end of the tubular casing is prevented from being opened, by maintaining a distance between the outlet opening of the dispensing device and the protrusion extending from the dispensing cap by means of the indicating unit.

To enhance securing the dispensing cap when attached to the second portion of the dispensing device, and to provide a save and well visible indication of the originality of the closure, the protrusion extending from the dispensing cap is an annular protrusion surrounding the dispensing cap, and the indicating unit is a tear-off strip surrounding the dispensing cap between the outlet opening of the dispensing device and the annular protrusion.

In order to prevent the tubular casing from being unintentionally damaged by the cutting element of the dispensing cap, the indicating unit has a height which is larger than the length of the cutting element in the dispensing direction. This indicating unit secures the dispensing cap, and thereby the tip end of the cutting element, at a distance from the first end of the filled tubular casing, which may be predefined according to the selected height of the tear-off strip.

For opening the packaging combination, the dispensing cap may comprise a cutting element, by means of which the tubular casing is opened at its first end, e.g. by screwing the attachment end of the dispensing cap into the dispensing device. In a further preferred embodiment of the inventive packaging combination a securing mechanism is provided for securing the dispensing cap in position when attached to dispensing device. The securing mechanism secures the dispensing cap on the dispensing device before the tubular casing has been opened as well as after the tubular casing has been opened. In other words, at each time after the assembling of the dispensing system or the packaging combination, respectively, the dispensing cap is secured at the dispensing system against unintentional detachment by the securing mechanism. In case that the dispensing cap is attached to the dispensing device by a screw-connection, the securing mechanism provides an unscrew locking for preventing the dispensing cap from being unintentionally unscrewed from the dispensing device.

The securing mechanism may be formed by any suitable means, depending on the specific construction of the dispensing device and the dispensing cap, and more particularly, on the specific kind of the connection between the dispensing device and the dispensing cap. In a specific embodiment, the securing mechanism comprises at least one pawl and at least one notch for engaging with the pawl. The pawl is constructed as to allow the notch to pass in one direction, and to prevent the movement of the notch in the counter direction.

One pawl which co-acts with one notch may be sufficient for providing a securing mechanism which secures the dispensing cap from unintentional detachment. In order to allow the dispensing cap to be secured in any suitable position, seen in axial direction of the central axis as well as in circumferential direction relative to the dispensing device, a plurality of pawls is provided extending from the inner radius of the flange of dispensing device towards the central axis of tubular casing. In another embodiment of the packaging combination, the cutting element acts as the at least one notch which engages with the pawls.

Further advantageously, a dispensing opening is provided at the dispensing end of the dispensing cap, via which the filling material may be dispensed after the tubular casing has been opened.

In order to allow dispensing of small amounts of filling material, the dispensing end terminates in a circular tip. The dispensing end advantageously is of a conical shape, thereby circular dispensing holes of different diameter may be formed, depending on the length of the portion cutoff from the dispensing end.

For avoiding an unintentional waste of filling material after the tightly filled tubular casing has been opened, a closure cap is provided reversibly attachable to the dispensing cap. The closure cap has an inner shape which matches the outer shape of the dispensing end.

According to a further advantageous embodiment, the dispensing end terminates in a flat nozzle. By means of said flat nozzle, filling material may be dispensed in the form of flat strip, e.g. for regularly dispensing the filling material on a surface.

For closing said flat nozzle, in a further advantageous embodiment, a closure cap is provided which is pivotally attached to the dispensing cap. The closure cap may be pivoted away from the dispensing opening for dispensing filling material, and may be pivoted back onto the dispensing opening for closing said dispensing opening, in order to avoiding an unintentional waste of filling material. For preventing the closure cap from unintentionally pivoting away from the dispensing opening, the closure cap may be secured to the dispensing opening by a snap-fit mechanism.

The object of the present invention may also be solved by a dispensing device for being attached to a tubular casing to form a packaging combination according to the invention described above.

Further advantages and a preferred embodiment will be described in the following together with the drawings listed below. The expressions "left", "right", "below" and "above" are referred to the drawings in an alignment such that the reference numbers used can be read in normal.

DETAILED DESCRIPTION

Figure 1:
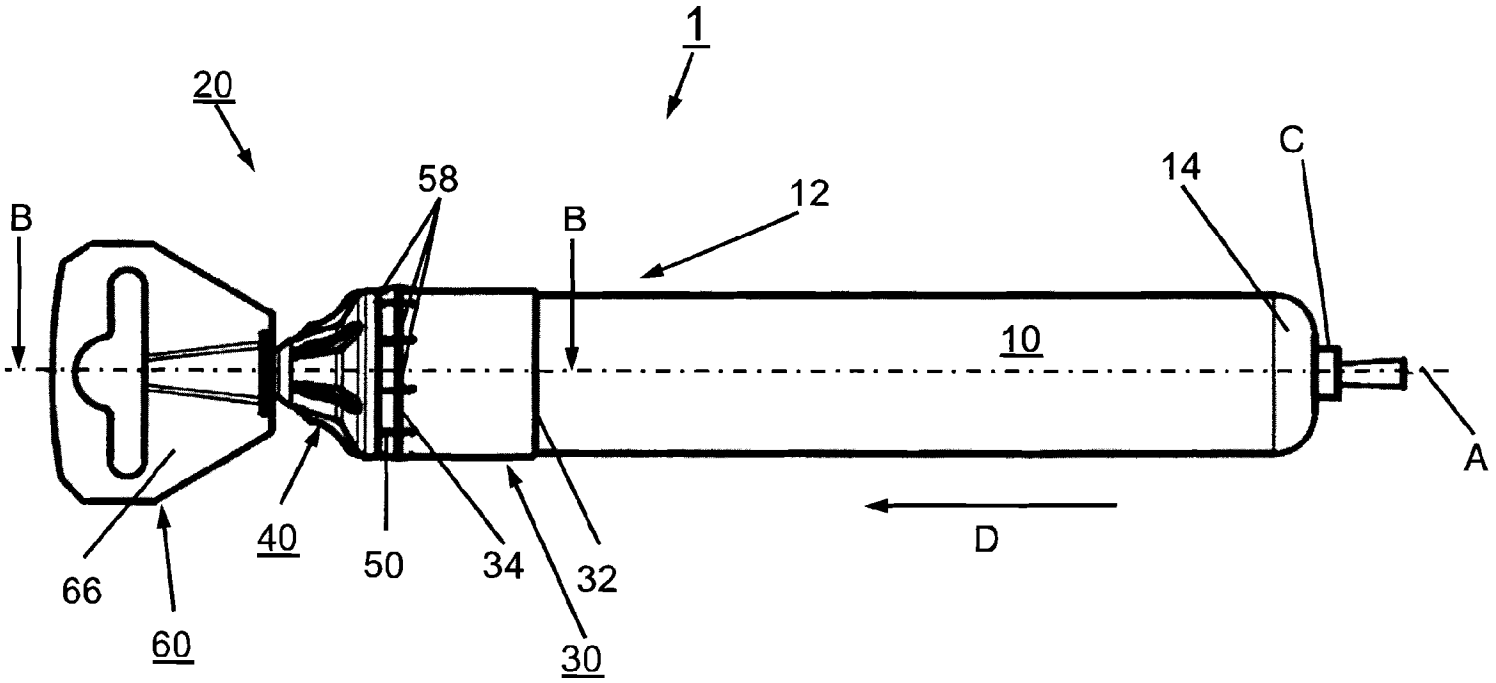
FIG. 1: is a plan view to a first embodiment of the packaging combination according to the present invention.

FIG. 1 shows a view to an embodiment of the packaging combination 1 according to the invention. The packaging combination 1 includes a sausage-shaped tubular casing 10 having a first end 12 and a second end 14 both closed by closure clips C, and a dispensing system 20 attached to first end 12 of tubular casing 10. Tubular casing 10 has a central axis A extending through first end 12 and second end 14. Dispensing system 20 includes a dispensing device 30, a dispensing cap 40, an indicating unit 50 in the form of a tear-off strip and a closure cap 60. Dispensing device 30 has an inlet opening 32 and an outlet opening 34 between which a passage way extends through dispensing device 30 coaxially to central axis A and in a dispensing direction D.

Figure 2:
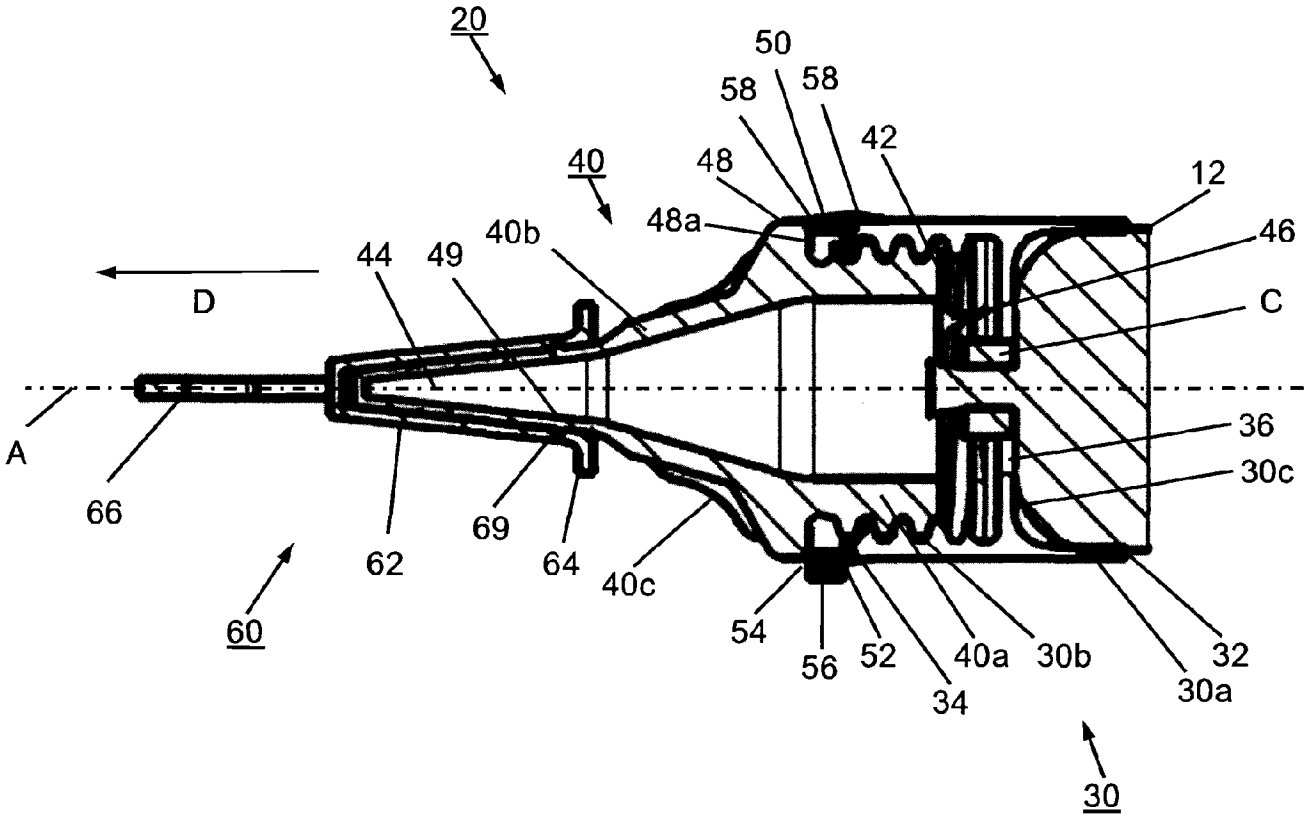
FIG. 2: is a longitudinal part section of the first embodiment of the packaging combination along line B-B shown in FIG. 1.

FIG. 2 is a longitudinal part section to the embodiment of the packaging combination 1 of FIG. 1 along line B-B, showing the first end 12 of the tightly filled tubular casing 10 closed by one closure clip C and the dispensing system 20 attached thereto.

As it can be seen in FIG. 2, dispensing device 30 according to the embodiment shown in FIGS. 1 and 2, has a substantially cylindrical shape, which is adapted to the cylindrical shape of tubular casing 10. Dispensing device 30 has a first portion 30*a* including an inlet opening 32 and a second portion 30*b* including an outlet opening 34. Between portions 30*a* and 30*b* of dispensing device 30, a circumferential flange 30*c* extends from the inner surface of the dispensing device 30 towards central axis A, having a central hole 36 which is part of the passage way through dispensing device 30. Flange 30*c* forms an abutment for tubular casing 10 when inserted into dispensing device 30.

As it can be seen in FIG. 2, tubular casing 10 abuts shoulder formed by the transition portion between the main portion of tubular casing 10 and the plait-like end closed by closure clip C against the surface of flange 30*c* facing in the direction towards inlet opening 32. The plait-like end of tubular casing 10 closed by closure clip C extends through central hole 36 into the inner part of portion 30*b* of dispensing device 30.

At inner surface of first portion 30*a* and/or at the surface of flange 30*c*, facing tubular casing 10, an adhesive, like a hot-melt adhesive or the like, may be provided for securing dispensing device 30 to tubular casing 10. The diameter of central hole 36 is larger than the outer diameter of the closure clip C at first end 12 of tubular casing 10, for allowing closure clip C to be guided through central hole 36. The inner surface of first portion 30*a* has a cylindrical shape with an inner diameter which corresponds to the outer diameter of tubular casing 10. At the inner surface of second portion 30*b*, an inner screw thread is applied, extending between flange 30*c* and outlet opening 34.

As shown in FIG. 2, dispensing cap 40 has an approximately cylindrical portion 40*a* and an approximately conical portion 40*b* attached to the cylindrical portion 40*a* by its larger diameter end or base end. Cylindrical portion 40*a* has a cylindrical through hole, and conical portion has a conical through hole. The inner diameter of cylindrical portion 40*a* corresponds to the inner diameter of the base end of conical portion 40*b*. The free end of cylindrical portion 40*a* of dispensing cap 40 facing tubular casing 10, forms an inlet end or attachment end 42, whereas the free end of the conical portion facing in dispensing direction D, forms a dispensing end 44.

At the outer surface of cylindrical portion 40*a* of dispensing cap 40, an outer screw thread is provided, matching the inner screw thread of second portion 30*b* of dispensing device 30. The outer screw thread at cylindrical portion 40*a* extends from attachment end 42 towards the junction between cylindrical portion 40*a* and conical portion 40*b*. Its axial length at least approximately corresponds to the axial length of the inner screw thread of second portion 30*b*.

Screw thread shown in FIG. 2, is a round threads. Naturally, any other suitable kind of thread may e used, like trapezoid thread or metric thread.

The surface of attachment end 42, facing flange 30*c* of dispensing device 30, has an annular shape. A cutting element in the form of a spike 46 is provided at said annular surface, extending towards first end 12 of tubular casing 10. Spike 46 has an approximately triangular shape, and is attached to attachment end 42 by its base, and terminates in a sharpened tip end. As it can be seen in FIG. 2, spike 46 is positioned at a radial distance from central axis A, which is smaller than the radius of hole 36 of flange 30*c*. This allows spike 46 to engage hole 36, and thus, also to engage and to open first end 12 of tubular casing 10, when dispensing cap 40 is screwed in into second portion 30*b* of dispensing device 30.

In the originally closed condition of packaging combination 1 as shown in FIG. 2, dispensing cap 40 is not fully screwed in into second portion 30*b* of dispensing device 30. Thus, tip end of cutting element 46 does not engage central hole 36, and also may not engage first end 12 of tubular casing 10.

Moreover, on the outer surface of dispensing cap 40, in particular, at the junction between cylindrical portion 40*a* and conical portion 40*b*, a circumferentially extending protrusion or rim 48 is provided. Protrusion or rim 48 has an outer diameter which is at least equal to the outer diameter of dispensing device 30, thereby an annular surface 48*a* is formed facing outlet opening 34 of dispensing device 30.

As it can be seen in FIG. 2, dispensing cap 40 is not completely screwed into second portion 30*b* of dispensing device 30. Thereby, a gap is provided between annular surface 48*a* of rim 48 of dispensing cap 40 and outlet opening 34 of dispensing device 30. In said gap, an indicating unit in the form of a tear-off strip 50 is arranged, for indicating the originality of the closure of the packaging combination, in particular the originality of the closure of the dispensing opening of the dispensing system 20. When attached to dispensing system 30, tear-off strip 50, at least approximately, has the shape of a hollow cylinder, with a first end 52 directed towards dispensing device 30 and a second end 54 directed towards annular surface 48*a* of rim 48. Tear-off strip 50 further comprises a handle 56 for enhancing pulling off tear-off strip 50 from dispensing system 20.

Indicating unit or tear-off strip 50 surrounds the end of the outer screw thread of cylindrical portion 40*a* of dispensing cap 40. The at least approximately cylindrical outer shape has a diameter corresponding to the outer diameter of dispensing device 30 or rim 48. Handle 56 extends from the outer shape of tear-off strip 50.

As it can be seen in FIG. 1, tear-off strip 50 is attached by its first end 52 to outlet opening 34 of dispensing device 30 by welded spots 58 (see FIG. 1) arranged in regular intervals around outlet opening 34. Furthermore, the second end 54 of tear-off strip 50 is attached to rim 48 of dispensing cap 40 by respective welded spots 58. The axial length of tear-off strip 50, namely the distance between its first and second end 52, 54, corresponds to the axial length of spike 46, to ensure that spike 46 does not comes in contact with first end 12 of tubular casing 10, when dispensing system 30 is originally closed.

Closure cap 60 is attached to dispensing end 44 of conical portion 40*b*. Closure cap 60 includes a conical member 62, a flange member 64 surrounding the largest diameter end or base end of conical member 62, and radially extending therefrom. Conical member 62 has an axial length shorter than the axial length of conical portion 40*b* of dispensing cap 40. The axial length of conical member 62, according to FIG. 2, is approximately the half of the length of conical portion 40*b*. The inner shape of conical member 62 corresponds to the outer shape of the section of conical portion 40*b*, which is covered by conical member 62. This section of conical portion 40*b* has an approximately constant wall thickness, whereas the section of conical portion 40*b*, which is not covered by closure cap 60, has a larger and non constant wall thickness and, additionally comprises ribs 40*c* arranged in regular intervals at its outside. Ribs 40*c* are axially aligned and extend radially from conical portion 40*b*.

Closure cap 60 further comprises a flat fin member 66 (see FIG. 1) arranged in a plane extending through longitudinal axis A of tubular casing 10, when being attached to dispensing device 30. Fin member 66 includes an opening arranged above conical member 62 in the dispensing direction D, for forming a hanger by which packaging combination 1 may be hung up, e.g. for presentation or the like.

For securing closure cap 60 to dispensing cap 40, a circumferential extending groove 69 is arranged at the inner surface of closure cap 60. At the outer surface of conical portion 40*b*, a corresponding circumferentially extending notch 49 is provided for engaging groove 69 of closure cap 60 when attached to dispensing cap 40.

Figure 3:
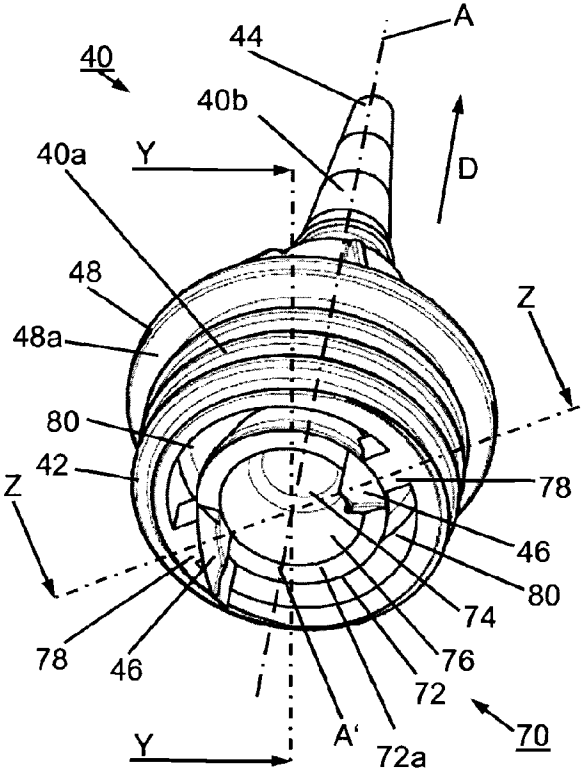
FIG. 3: is a perspective view to a dispensing cap according to a second embodiment of the packaging combination of to the present invention.

FIG. 3 is a perspective view to a dispensing cap 40 according to a second embodiment of the packaging combination 1 of to the present invention. Similar to the first embodiment of the inventive packaging combination 1 including the dispensing system 20, dispensing cap 40 according to the second embodiment of packaging combination 1 also has an approximately cylindrical portion 40*a* an approximately conical portion 40*b*, with an inlet end or attachment end 42 and a dispensing end 44, respectively.

As it can be seen in FIG. 3, dispensing cap 40 according to the second embodiment of packaging combination 1 comprises a cap member 70. Cap member 70 has an opened end 72 and a closed end 74, which are coupled by a conically shaped circular wall 76. Cap member 70 further has a central axis A', which extends centrally through opened and closed ends 72, 74. Central axis A' of cap member 70, according to the embodiment shown in FIGS. 3 to 5, coincides with central axis A of tubular casing 10. The closed end 74 f cap member 70 is formed by a flat element, but may also be formed by an element of any suitable form, like a spherical, partially spherical or pyramidal element terminating in a tip end. Opened end 72 of cap member 70 has an annular shape and terminates in an annular surface 72*a* which faces towards tubular casing 10, when attached to dispensing device 20. Annular surface 72*a* of cap member 70 is arranged in a plane defined by the annular surface of attachment end 42 of dispensing cap 40.

Cap member 70 is fixed to dispensing cap 40 by two bars 78 extending between the outer surface of cap member 70 and the inner surface of cylindrical portion 40*a* of cap member 40. Bars 78 have an approximately rectangular cross-section and extend in a plane parallel to annular surface 72*a* of cap member 72. Two approximately semi-circular slots 80 are formed between the outer surface of cap member 70 and the inner surface of cylindrical portion 40*a* of cap member 40.

As it further can be seen in FIG. 3, in the second embodiment of the dispensing cap 40, two cutting elements 46 are attached to annular surface 72*a* of cap member 70, in the region of the conjunction of cap member 70 and bars 78, whereby slots 80 extending between bars 78, and thus, the passage way for the filling material when being squeezed out of packaging combination 1, are not blocked by cutting elements 46.

Figure 4:
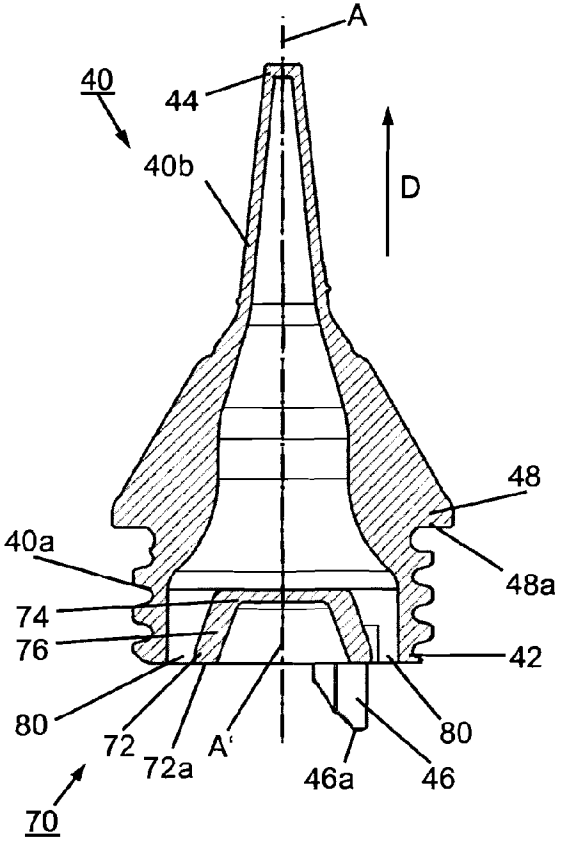
FIG. 4: is a longitudinal cross-section of the dispensing cap along line Y-Y through the central axis, shown in FIG. 3.

FIG. 4 is a longitudinal part section of dispensing cap 40 along line Y-Y shown in FIG. 3. Cap member 70 is centrally arranged in dispensing cap 40, in the region of attachment end 42, with central axis A' coinciding with central axis A. Cap member 70 is arranged in dispensing cap 40 in a manner that annular surface 72*a* of opened end 72 lies in the same plane as the annular surface of attachment end 42 of dispensing cap 40, and concentrically thereto. Between the outer surface of cap member 70 and the inner surface of cylindrical portion 40*a* of cap member 40, slots 80 are formed, providing a passage way for the filling material along cap member 70. Wall 76 of cap member 70 has a conical shape. Accordingly, the cross-section of slots 80 expands in filling D.

Cutting elements 46 (in FIG. 4, only one of them is visible), comprise a body attached to cap member 70 by one end, and a cutting edge 46*a* at the other end, facing away from cap member 70.

Figure 5:
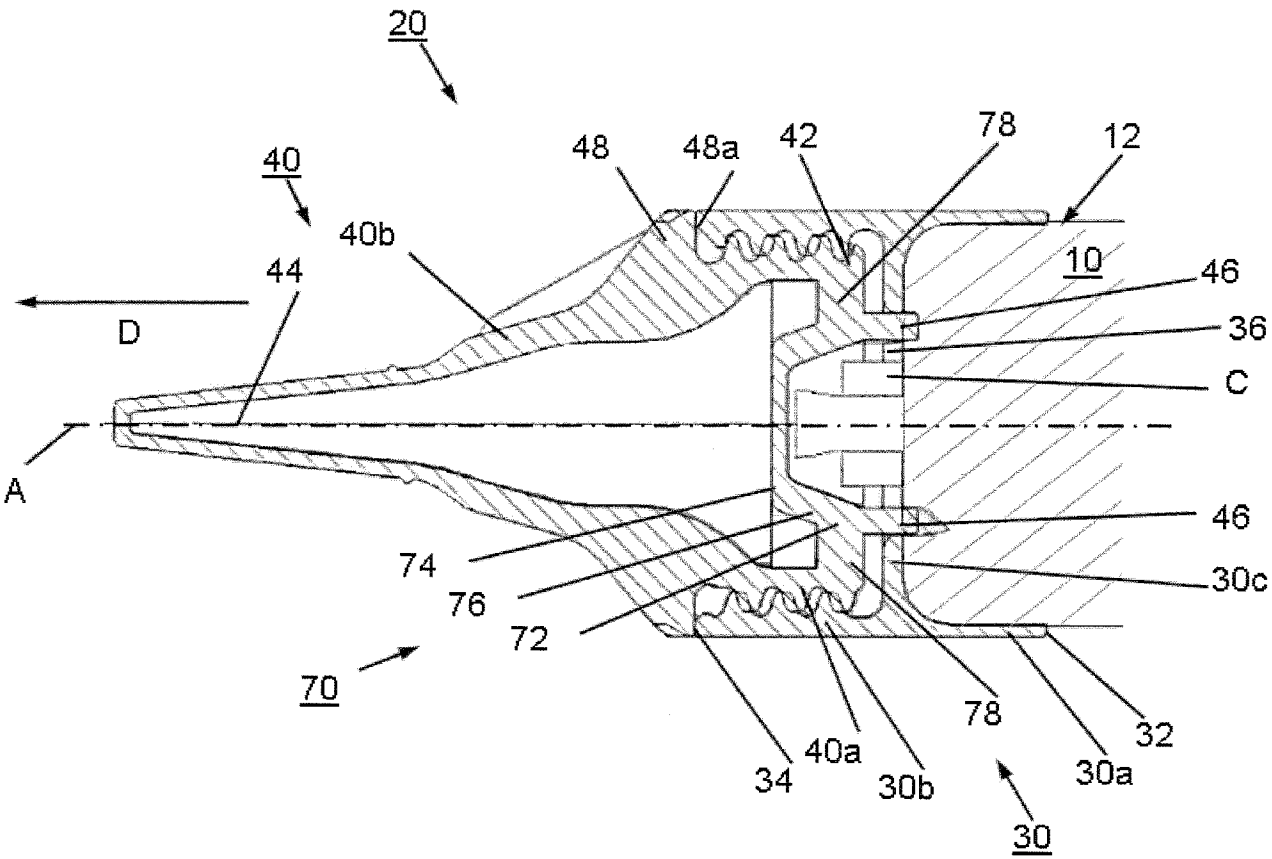
FIG. 5: is a longitudinal cross-section of the embodiment of the packaging combination along line Z-Z through the central axis, shown in FIG. 3.

FIG. 5 is a longitudinal part section of the second embodiment of packaging combination 1 along line Z-Z shown in FIG. 3, in a situation, in which indicating unit 50 has been removed, and dispensing cap 40 having an outer screw thread, is completely screwed in into the internal screw thread of dispensing device 30. As it further can be seen, when dispensing cap 40 is completely screwed in into dispensing device 30, annular surface 48*a* of rim 48 of dispensing cap 40 abuts outlet opening 34 of dispensing device 30. Cutting elements or spikes 46 extending through central hole 36 of dispensing device 30, and penetrating the casing material surrounding clip C.

As it can further be seen in FIG. 5, an approximately annular space is left between the annular surface of attachment end 42 of dispensing cap 40 and the surface of flange 30*c* of dispensing device 30 facing towards dispensing cap 40. This annular shaped space is part of the passage way for the filling material when being squeezed out of packaging combination 1.

As shown in FIG. 5, cap member 70 accommodates the plait-like portion of first end 12 of tubular casing 10 together with clip C attached thereto. In particular, cap 70 accommodates the complete portion cut off from first end 12 by cutting elements 46, which includes clip C, the plat-like portion and the casing material remaining at said plait-like portion, which is thereby prevented from being shifted towards outlet end 44 of dispensing cap 40.

Moreover, in order to provide a passage way of sufficient size, the wall thickness of cylindrical portion 40*a* of dispensing cap 40 according to the second embodiment shown in FIGS. 3 to 5, is smaller than the wall thickness of cylindrical portion 40*a* of dispensing cap 40 of the first embodiment according to FIGS. 1 and 2, at least in the region of cap member 70.

Depending on the size of tubular casing 10 and, accordingly to the size of the plait-like portion and clip C closing said plait-like portion as well as the shape of dispensing cap 40, cap member 70 may have a shape different from the that shown in FIGS. 1 to 3.

Figure 6:
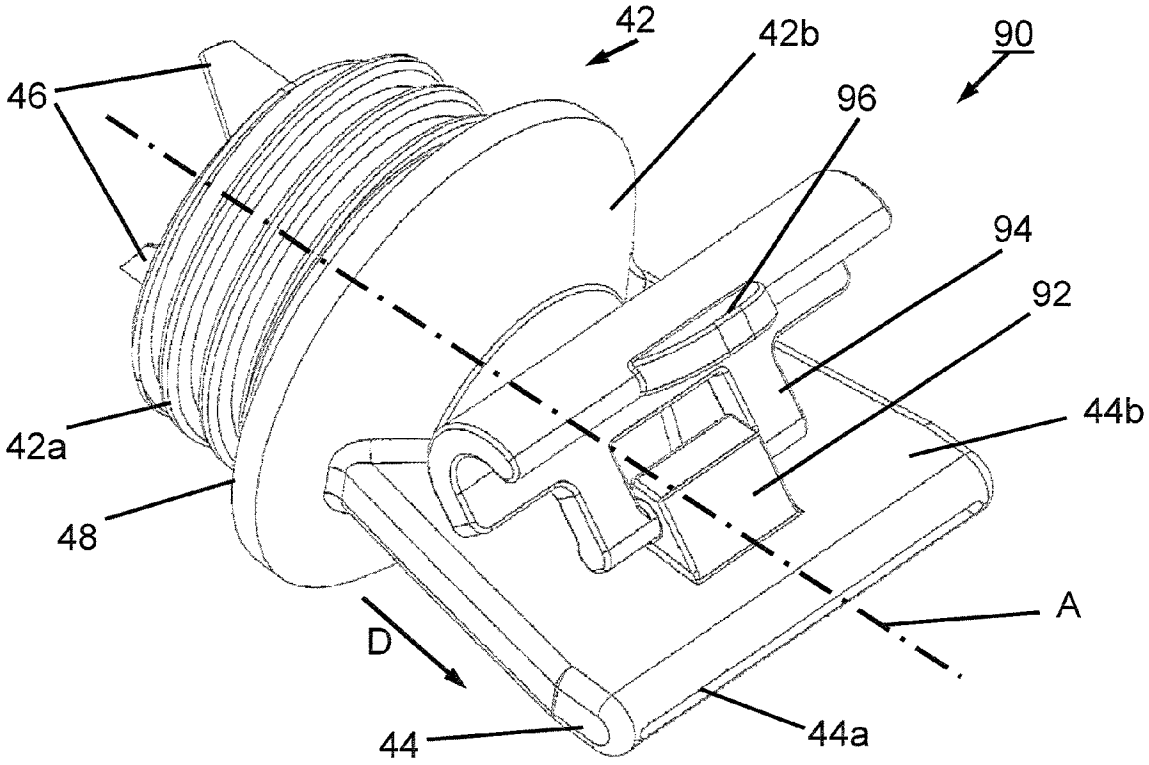
FIG. 6: is a perspective view to a dispensing cap according to a third embodiment of the packaging combination of to the present invention.

FIG. 6 is a perspective view to a dispensing cap 40 according to a third embodiment of the packaging combination of the present invention.

Similar to the second embodiment of the inventive packaging combination 1 including the dispensing system 20, dispensing cap 40 according to the third embodiment of packaging combination 1 also comprises an approximately cylindrical portion 40*a* with an outer crew thread on its outer surface and an approximately conical portion 40*b*, with an inlet end or attachment end 42 and a dispensing end 44, respectively. Moreover, dispensing cap 40 according to the third embodiment further comprises a cap member 70 as described in conjunction with the second embodiment of dispensing cap 40 (see also FIG. 7).

As it can be seen in FIG. 6, dispensing end 44 of dispensing cap 40 terminates in a flat nozzle with a slot-like opening or dispensing slot 44*a*. Dispensing slot 44*a* extends vertically to and in the plane of central axis A of dispensing cap 40. In order to realize the flat nozzle, a fin-like protrusion or fin member 44*b* extends at both sides of conical portion 40*b* and in dispensing direction D. Fin member 44*b* has an approximately trapezoid shape with side surfaces diverging in dispensing direction D.

Dispensing cap 40 according to FIG. 6 further comprises a closure cap 90. Closure cap 90 has an approximately C-shaped cross-section and has a length corresponding to the width of dispensing slot 44*a*. Closure cap 90 has an inner shape which matches the outer shape of dispensing end 44.

Closure cap 90 is arranged parallel to dispensing slot 44*a* on one of the flat surfaces of fin member 44*b*, and pivotally attached thereto by a hinge assembly including a fixed portion 92 attached to fin member 44*b* and a wing portion 94 fixed to closure cap 90, and pivotally held in fixed portion 92. Fixed portion 92 has an approximately C-shaped inner surface with a cylindrical through hole extending in a direction parallel to dispensing slot 44*a*. Wing portion 94 comprises a cylindrical bolt extending through the hole in fixed portion 92 to which it snap-fits in order to come in pivotal engagement. On the free edge of the C-shape of closure cap 90, a handle 96 in the form of a latch is arranged for enabling an easy opening and closing of closure cap 90.

Figure 7:
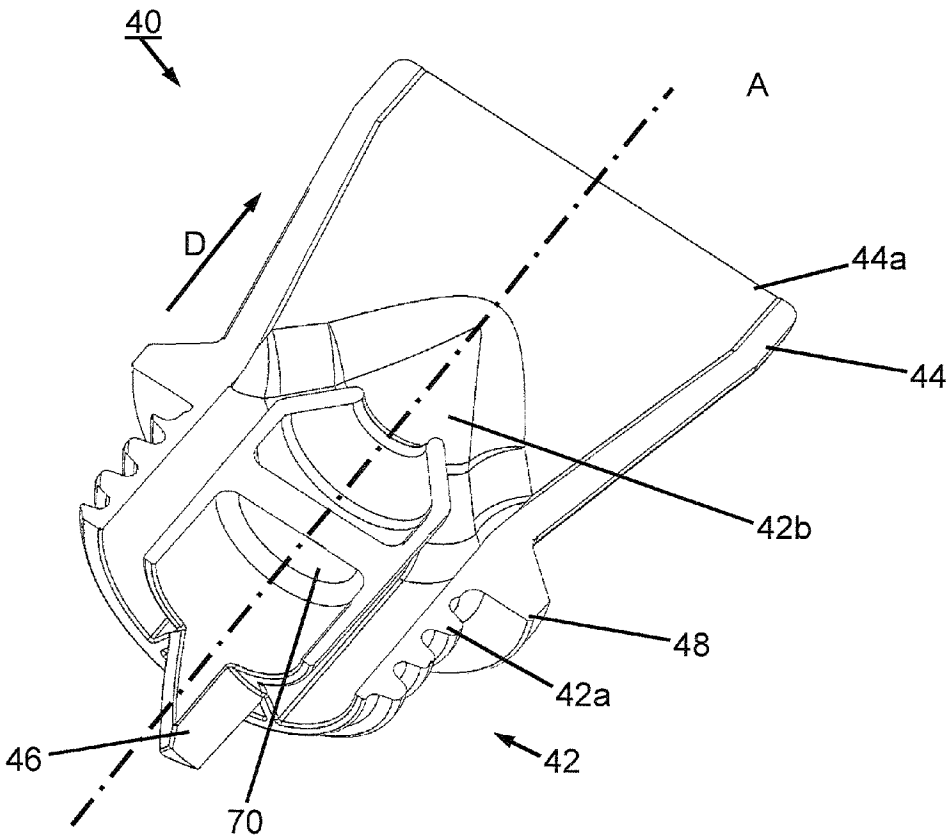
FIG. 7: is a longitudinal cross-section of the dispensing cap of FIG. 6, in a plane parallel to a flat nozzle and through the central axis.

FIG. 7 is a longitudinal par or cross-section of dispensing cap 40 of FIG. 6, in a plane parallel to the flat nozzle and through central axis A.

Cylindrical portion 40*a* of dispensing cap 40 is of a similar construction as described in conjunction with the second embodiment according to FIGS. 3 of 5, and includes an outer screw thread on its cylindrical outer surface, a circumferentially arranged protrusion 48 in the region between cylindrical portion 40*a* and conical portion 40*b* as well as a cap member 70 arranged in cylindrical portion 42*a* of dispensing cap 40.

As it can be seen in FIG. 7, fin member 44*b* extends at both sides of conical portion 40*b* and in dispensing direction D, starting from circumferential protrusion 48. The conical shaped inner space of conical portion 42*b* merges into a flat cubical space in fin member 44*b* terminating in dispensing slot 44*a* at dispensing end 44.

Figure 8:
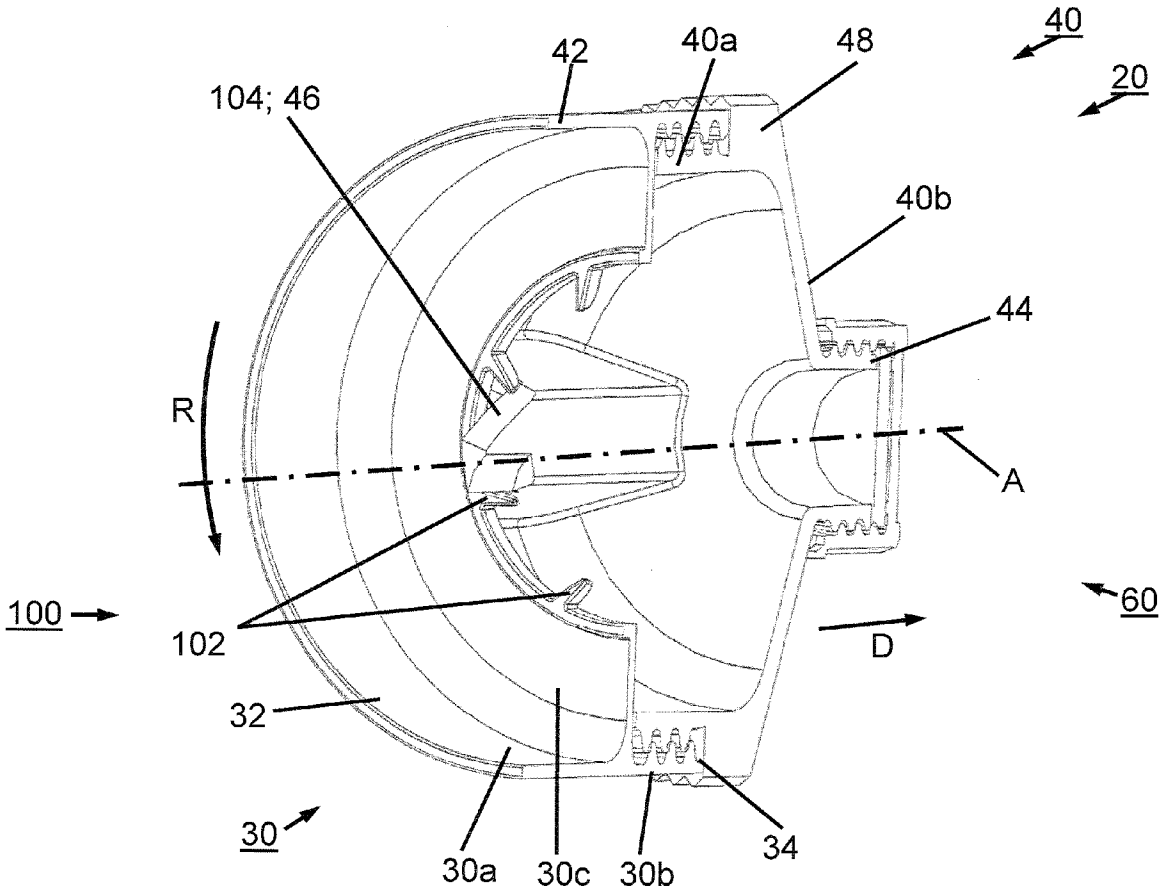
FIG. 8: is a perspective view to a longitudinal cross-section of a fourth embodiment of a dispensing system through the central axis.

FIG. 8 is a perspective view to a longitudinal part or cross-section of a fourth embodiment of dispensing system 20 through central axis A.

As it can be seen in FIG. 8, dispensing system 20 comprises a dispensing device 30 having a first cylindrical portion 30*a* including an inlet opening 32, a second cylindrical portion 30*b* including an outlet opening 34 and a circumferential flange 30*c* which extends between cylindrical portions 30*a* and 30*b* from the inner surface of the dispensing device 30 towards central axis A, as described in conjunction with the first and second embodiments according to FIGS. 2 to 7.

Dispensing cap 40 according to FIG. 8, has an approximately cylindrical portion 40*a* and an approximately conical portion 40*b* attached to the cylindrical portion 40*a* by its larger diameter end, and which tapers in dispensing direction D. The free end of cylindrical portion 40*a* of dispensing cap 40 facing tubular casing 10, forms attachment end 42 and, the free end of the conical portion facing in dispensing direction D, forms a dispensing end 44. Dispensing end 44 according to the fourth embodiment has an outer screw thread to which closure cap 60 is attached, which has an approximately cylindrical shape and which comprises an inner screw thread matching the outer screw thread of dispensing end 44. A cutting element 46 is attached to conical portion 40*b* of dispensing cap 40.

Dispensing cap 40, in FIG. 8, is screwed into second portion 30*b* of dispensing device 30 in rotation direction R, which is counterclockwise when seen in dispensing direction D, and outer circumferential protrusion or rim 48 of dispensing cap 40 abuts outlet opening 34 of dispensing device 30. Cutting element or spike 46, thereby, has opened first end 12 of tubular casing 10 (not shown in FIG. 8).

As it further can be seen in FIG. 8, dispensing system 20 comprises a securing mechanism 100. Securing mechanism 100 according to FIGS. 8 and 9, has eight pawls 102 in the form of fins which extend approximately radially towards central axis A from the inner diameter of circumferential flange 30*c* and in the plane defined by flange 30*c*, but declining in rotation direction R. Securing mechanism 100 further comprises at least one notch 104 for engaging with the pawls 102. In FIG. 8, notch 104 is formed by spike 46. Naturally, independently from spikes 46, one ore more separate notches 104 may be arranged such that notches 104 engage pawls 102 when dispensing cap 40 is screwed into dispensing device 40. Alternatively, notches 104 may be separate parts, but integrally be formed with spikes 46. In other words, notches 104 may realized be specific portions of spikes 46.

Figure 9:
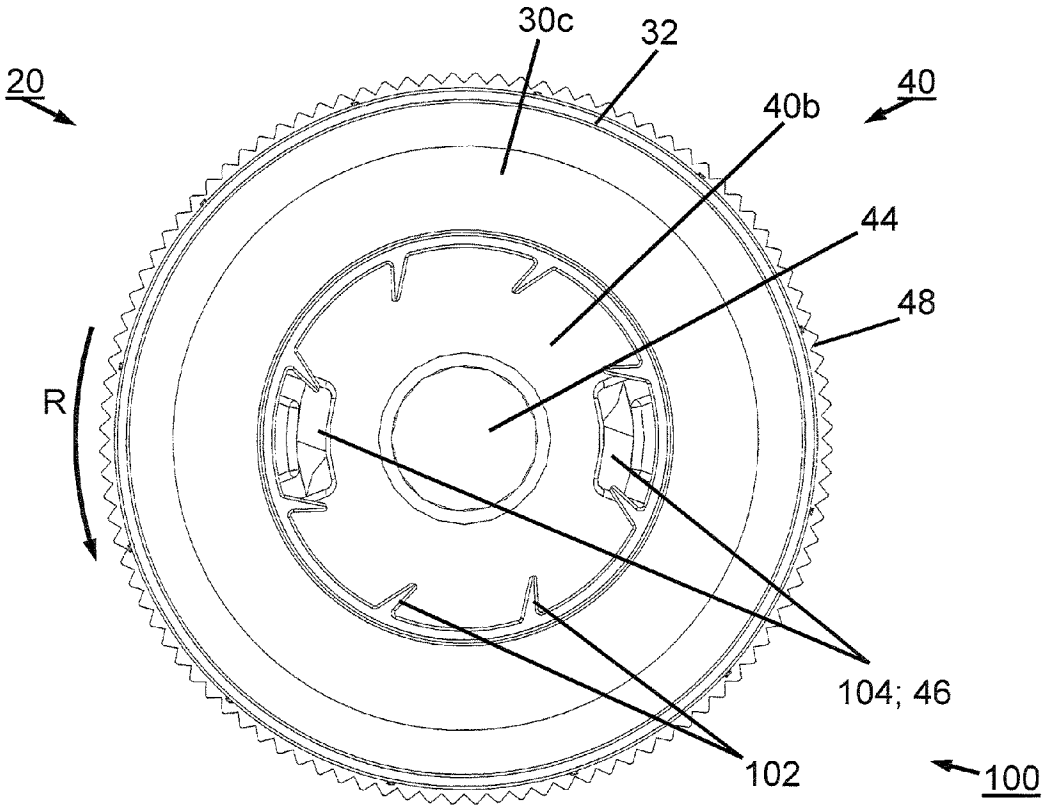
FIG. 9: is a plane view to the embodiment of the dispensing system of FIG. 8, seen in the dispensing direction.

FIG. 9 is a plane view to the fourth embodiment of dispensing system 20 according to FIG. 8, seen in dispensing direction D.

Pawls 102 are arranged in regular intervals at the inner diameter of flange 30*c*. The distance between two adjacent pawls may correspond to the width of spikes 46, but is at least a little larger than said width to enable spikes 46 to engage between two adjacent pawls 102.

In FIG. 9, eight pawls 102 and two notches formed by spikes 46, are provided. Pawls 102 and notches 104 are arranged in regular intervals, whereby, at each time, both notches 104 are in engagement with pawls 102, which means that they are positioned between two adjacent pawls 102. To enable that all notches 104, when in the engagement position between two adjacent pawls 102, the number of pawls 102 should amount to a multiple of the number of notches 104.

For opening packaging combination 1 and dispensing the filling material contained in tubular casing 10, handle 56 of indicating unit or tear-off strip 50 is grabbed and pulled-off from dispensing system 20 in a radially direction, by breaking open welded spots 58. After tear-off strip 50 is removed, the gap between annular surface 48*a* of rim 48 of dispensing cap 40 and outlet opening 34 of dispensing device 30 is released. Thereafter, dispensing cap 40 may finally be screwed in into second portion 30*b* of dispensing device 30, according to height of the gap which corresponds to e.g. one revolution of the screw thread of dispensing cap 40, until annular surface 48*a* of rim 48 abuts outlet opening 34 of dispensing device 30.

While screwing in dispensing cap 40 into dispensing device 30, spike 46 extending from attachment end 42 towards tubular casing 10, is moved through hole 36 of flange 30*c* and in axial direction towards first end 12 of tubular casing 10. Due to the fact that dispensing cap 40 is screwed in into dispensing device 30, spike 46 also executes a circular movement about central axis A.

Spike 46, while moving towards first end 12 of tubular casing 10, penetrates the casing material and, due to its circular movement, partially ruptures the casing material around closure clip C. The partially cut off plait-like portion together with clip C is halt at first end 12 of tubular casing 10 by the remaining casing material being not cut off.

According to the second embodiment of packaging combination 1, cap member 70 is arranged above closure clip C of first end 12. After the casing material has been partially ruptures around closure clip C, the plait-like portion together with closure clip C pivoting away from first end 12 about the remaining casing material being not cut off, is accommodated by cap member 70, which prevents closure clip C and the plait-like portion from being shifted towards and blocking of dispensing end 44 of dispensing cap 40.

Since, according to said second embodiment of packaging combination 1, two cutting elements or spikes 46 are provided, and due to its circular movement, the casing material around closure clip C may not only be partially ruptured. The plait-like portion together with closure clip C may completely be cut off. Cap member 70 accommodates and keeps the cut off plait-like portion together with closure clip C.

According to the radial distance of cutting elements 46 from central axis A', the circular portion of the casing material being cut off together with the plait-like portion has a size which, completely or at least partially, may cover closure clip C when accommodate in cap member 70. Thereby the filling material, when passing cap member 70 and closure clip C while being squeezed out, is prevented from contacting closure clip C and/or the outer surface of the casing material. Thereby a possible contamination of the filling material during dispensing is prevented.

It has to be noted that the length of spike 46, the axial length of tear-off strip 50 as well as the screw in depth of dispensing cap 40 have to be chosen such, that closure clip C is not fully cut off from first end 12 of tubular casing 10, to avoid closure clip C from blocking the passage way for the filling material through dispensing cap 40.

After tubular casing 10 is ruptured by spike 46, the filling material may be dispensed just by squeezing the filled tubular casing 10.

The packaging combination 1, in particular dispensing end 44 of dispensing cap 40, may be closed by closure cap 60 which may be attached to dispensing cap 40 and secured thereon by notch 49 of conical portion 40*b*, which engages groove 69 of closure cap 60.

According to the second embodiment of packaging combination 1, cap member 70 is fixed to dispensing cap 40 by two bars 78, and comprises two cutting elements or spikes 46. It has to be understood, that cap member 70 may be fixed to dispensing cap 40 by only one bar or by more than two bars, like by four bars which e.g. may be regularly arranged around the cap member in angles of 90°. Also, only one or more than one cutting element or spike may be provided. The number of cutting elements may correspond to the number of bars fixing the cap member. Accordingly, the cutting elements should be arranged at the respective conjunction between the bars and the cap member, in order to leave the most possible space for the passage way for the filling material.

Cap member 70 has been described as being arranged concentrically in dispensing cap 40, forming approximately semi-circular slots 80 between cap member 70 and the inner surface of dispensing cap 40. Naturally, the cap member may not necessarily be arranged centrally in the dispensing cap. The cap member may also be eccentrically arranged, e.g. directly attached to the inner surface of the dispensing cap. Essentially in the sense of the present invention is that the cap member covers or accommodates the plait-like portion together with the closure clip at least when being partially or completely cut off from the first end of the tubular casing.

It has to be understood that, before dispensing filling material, closure cap 60 has to be removed from dispensing cap 40 to uncover dispensing end 44 of conical portion 40*b*. Dispensing end 40 may be closed by a membrane or the like. Thus it may be necessary to remove said membrane. Moreover, depending on the kind of filling material and the amount of filling material to be dispensed, the section of conical portion 40*b* covered by closure cap 60, may partially be cut off according to the desired size of the opening at dispensing end 44.

According to the embodiments of the inventive packaging combination described above, dispensing cap 40 has been attached to dispensing device 30 by means of outer and inner screw threads. Other attachment means may be used, like a bayonet connector. In this case, cylindrical portion 40*a* of dispensing cap 40 may be provided with pins radially extending, and second portion 30*b* of dispensing device 30 may comprise appropriate slots which may be engaged by said pins.

Closure cap 60 has been described as being secured to conical portion 40*b* of dispensing cap 40 by notch 49 of conical portion 40*b*, which engages groove 69 of closure cap 60. Alternatively, as described in conjunction with the fourth embodiment of the dispensing system 20 according to FIGS. 8 and 9, also conical portion 40*b* of dispensing system 20 according to FIGS. 1 and 7 may comprise an outer screw thread, and conical member 62 of closure cap 60 may be provided with an inner screw thread matching said outer screw thread.

Moreover, spike 46 has a sharpened tip end. In order to achieve a controlled opening of the first end of the tubular casing, spike 46 may have the form of a blade, including a sharpened cutting edge. Additionally, more than one cutting element may be provided, which then preferably may be arranged in regular intervals at attachment end 42 of closure cap 60.

In conjunction with FIGS. 1 to 5, tubular casing 10 has been described as having a circular cross section. Naturally, the casing 10 containing the filling material may be of any other suitable cross-section, like a rectangular or triangular cross-section. Accordingly, also at least the first portion 30*a* of dispensing device 30 should also have a corresponding cross-section to be form-fit attached to the casing 10.

Dispensing device 30 and dispensing cap 40 have been described as comprising first and second portions or cylindrical and conical portions, respectively. It has to be understood, that each of dispensing device 30 or dispensing cap 40 is an integrally formed part which is not composed of single first and second portions. Moreover, dispensing system 20 in its originally closed condition, including dispensing device 30, closure cap 40 and indicating unit 50, may also be integrally formed, e.g in a laser sintering operation.

Even if not shown, also dispensing cap 40 according to FIGS. 3 to 5 may also be provided with a closure cap 60 for closing the dispensing opening of dispensing end 44.

Moreover, also closure cap 90 according to the third and fourth embodiment of dispensing cap 40 may comprise a hanger as described in conjunction with FIG. 1.

In the fourth embodiment of dispensing system 20 according to FIGS. 8 and 9, a cap member 70 for accommodating closure clip C cut-off from first end 12 of tubular casing 10 when being opened, has not been described. Naturally, also in the third embodiment according to FIGS. 6 and 7, dispensing system 20 may comprise a cap member 70 as described in conjunction with the second and third embodiments of dispensing system 20.

Securing mechanism 100 of FIGS. 8 and 9 comprises pawl 102 extending approximately radially from flange 30*c* of dispensing device 30 towards central axis A. It is also possible that said pawls extend from the dispensing device in axial direction towards the dispensing cap. In this case, the dispensing cap should comprise corresponding notches axially directed towards the axially directed pawls in order to engage said axially directed pawls.

It has to be noted that the specific construction of the pawls is not limited to the fin-shaped pawls shown in FIGS. 8 and 9. Any suitable form may be used, which allows one or more notches or the like to pass said pawls in one direction, and to prevent or at least impede a movement of said pawls in the counter direction.

The material used for the dispensing system, like a suitable plastic or metal, may be selected depending on the production method for the dispensing system or the filling material to be dispensed.

For being dispensable by dispensing device 20, the filling material should be of a respective consistency, e.g. pasty, fluid or granular. Accordingly any filling material being of said consistency, may be packed and dispensed by the packaging combination 1 of the present invention, chemical filling materials, like silicone or grease, as well as food stuff, like sausage meat or the like.

As described above, the present packaging combination 1 may be used without the need of any dispensing or pressing tools. Naturally, in particular when having a tubular casing of a circular cross section, known dispensing or pressing tools may be used to dispense the filling material from the inventive packaging combination.

What is claimed is:

1. A packaging combination for accommodating and dispensing a viscous or granular filling material, the packaging combination comprises:

a tubular casing having a first end, a second end and a central axis extending through the first and second ends, wherein the tubular casing is tightly filled with filling material and closed at its first and second ends by closure clips; and a dispensing system including a dispensing device having a passageway extending through the dispensing device with an inlet opening at its one end and an outlet opening at its other end for guiding and dispensing the filling material in a dispensing direction, and being attached to the first end of the tightly filled tubular casing, wherein the first end of the tubular casing extends inside the passageway of the dispensing device; wherein the dispensing system further comprises a dispensing cap having an attachment end and a dispensing end, which is reversibly attachable to the outlet opening of the dispensing device by its attachment end, by turning of the dispensing cap relative to the dispensing device in a circular movement about the central axis, wherein the dispensing cap includes a cap member formed therewith having at least one cutting element for opening the tubular casing at its first end as the at least one cutting element undergoes the same amount of relative circular movement about the central axis as the circular movement of the dispensing cap including the cap member relative to the dispensing device, wherein the cap member has a central axis, an opened end, a closed end, and a space therein between the opened and closed ends sized to receive a portion of the first end of the tubular casing including the closure clip, with the opened end having an annular shape and terminating in an annular surface facing towards the tubular casing, arranged at the attachment end of the dispensing cap and coaxially aligned to the central axis, with its opened end directed towards the tubular casing, and wherein the at least one cutting element is attached to the annular surface of the cap member such that the turning of the dispensing cap including the cap member relative to the dispensing device in a circular movement about the central axis causes the portion of the first end of the casing including the closure clip to be cut off from the tubular casing by the at least one cutting element and received in the space of the cap member.

2. The packaging combination according to claim 1, wherein the at least one cutting element extends from the attachment end of the dispensing cap in a direction opposite to the dispensing direction.

3. The packaging combination according to claim 1, wherein the at least one cutting element is arranged in the region of the opened end of the cap member.

4. The packaging combination according to claim 1, wherein an indicating unit for indicating the originality of the closure of the dispensing system is provided at the dispensing system.

5. The packaging combination according to claim 4, wherein, in the originally closed condition of the packaging combination, the indicating unit is adapted to fix the dispensing cap in a predefined position relative to the dispensing device.

6. The packaging combination according to claim 5, wherein the dispensing device includes at least a first portion and a second portion, wherein the first portion extends from the inlet opening of the passageway in the dispensing direction and the second portion extends from the outlet opening opposite to the dispensing direction, and wherein the inner circumferential dimensions of the first portion corresponds at least approximately to the outer circumferential dimensions of the tubular casing.

7. The packaging combination according to claim 6, wherein a circumferential flange extends at the inner surface of the dispensing device in a region between the first portion and the second portion.

8. The packaging combination according to claim 5, wherein an internal screw thread is provides at the outlet opening of the dispensing device, and wherein a corresponding external screw thread is provided at the attachment end of the dispensing cap for being attached to the outlet opening of the dispensing device.

9. The packaging combination according to claim 4, wherein the dispensing cap comprises a protrusion extending at its outside in the region of the end of the external screw tread directed towards the dispensing end.

10. The packaging combination according to claim 9, wherein the indicating unit is a tear-off strip provided between the outlet opening of the dispensing device and the protrusion extending from the dispensing cap.

11. The packaging combination according to claim 10, wherein the protrusion extending from the dispensing cap is an annular protrusion surrounding the dispensing cap, and the indicating unit is a tear-off strip surrounding the dispensing cap between the outlet opening of the dispensing device and the annular protrusion.

12. The packaging combination according to claim 5, wherein a closure cap is provided reversibly attachable to the dispensing cap.

13. The packaging combination according to claim 4, wherein an internal screw thread is provided at the outlet opening of the dispensing device, and wherein a corresponding external screw thread is provided at the attachment end of the dispensing cap for being attached to the outlet opening of the dispensing device.

* * * * *